US006652730B1

(12) United States Patent
Lehmkuhl et al.

(10) Patent No.: US 6,652,730 B1
(45) Date of Patent: Nov. 25, 2003

(54) ALUMINUM ORGANIC ELECTROLYTES AND METHOD FOR ELECTROLYTIC COATING WITH ALUMINUM OR ALUMINUM-MAGNESIUM-ALLOYS

(75) Inventors: Herbert Lehmkuhl, Mülheim an der Ruhr (DE); Klaus-Dieter Mehler, Mülheim an der Ruhr (DE); Bertram Reinhold, Ingolstadt (DE)

(73) Assignee: Studiengesellschaft Kohle mbH, Mulheim an der Ruhr (DE)

( * ) Notice: Subject to any disclaimer, the term of this patent is extended or adjusted under 35 U.S.C. 154(b) by 0 days.

(21) Appl. No.: 09/857,013

(22) PCT Filed: Nov. 27, 1999

(86) PCT No.: PCT/EP99/09236

§ 371 (c)(1),
(2), (4) Date: May 30, 2001

(87) PCT Pub. No.: WO00/32847

PCT Pub. Date: Jun. 8, 2000

(30) Foreign Application Priority Data

Dec. 1, 1998 (DE) ..... 198 55 666

(51) Int. Cl.[7] ..... C25D 3/44; C25D 3/56
(52) U.S. Cl. ..... 205/236; 205/237
(58) Field of Search ..... 205/236, 237; 106/1.25

(56) References Cited

U.S. PATENT DOCUMENTS

| | | | | | |
|---|---|---|---|---|---|
| 2,849,349 | A | * | 8/1958 | Ziegler et al. | 205/233 |
| 3,672,964 | A | * | 6/1972 | Harwood | 205/233 |
| 4,778,575 | A | * | 10/1988 | Mayer | 205/67 |
| 5,015,750 | A | * | 5/1991 | Tran et al. | 556/187 |

FOREIGN PATENT DOCUMENTS

| | | |
|---|---|---|
| EP | 0 402 760 | * 12/1990 |
| GB | 1 421 320 | * 1/1976 |

* cited by examiner

*Primary Examiner*—Roy King
*Assistant Examiner*—William T. Leader
(74) *Attorney, Agent, or Firm*—Norris McLaughlin & Marcus

(57) ABSTRACT

Organoaluminum electrolytes and methods for the coating of electrically conductive materials with aluminum or aluminum-magnesium alloys, essentially and preferably consisting of $Na[Et_3Al—H—AlEt_3]$ for aluminum coating, or of either $K[AlEt_4]$ or $Na[Et_3Al—H—AlEt_3]$ and $Na[AlEt_4]$ and trialkylaluminum for alloy coating using solutions of these electrolytes in liquid aromatic hydrocarbons or mixtures thereof with aliphatic mono- or polybasic ethers, such as dimethoxyethane, and using soluble anodes of aluminum or of aluminum and magnesium, or of aluminum-magnesium alloy.

27 Claims, No Drawings

ALUMINUM ORGANIC ELECTROLYTES AND METHOD FOR ELECTROLYTIC COATING WITH ALUMINUM OR ALUMINUM-MAGNESIUM-ALLOYS

This application is a 371 of PCT/EP99/09236 filed on Nov. 27, 1999.

The present invention relates to organoaluminum electrolytes suitable for the electrolytic deposition of aluminum or aluminum-magnesium alloys on electrically conductive materials, and a method for this using soluble aluminum anodes or soluble aluminum and magnesium anodes or an anode made of an aluminum-magnesium alloy.

Organoaluminum complex compounds have been used for a long time for the electrolytic deposition of aluminum (dissertation H. Lehmkuhl, TH Aachen 1954, German Patent 1047450; K. Ziegler, H. Lehmkuhl, Z. anorg. allg. Chemie 283 (1956) 414; German Patent 1056377; H. Lehmkuhl, Chem. Ing. Tech. 36 (1964) 616; EP-A-0084816; H. Lehmkuhl, K. Mehler and U. Landau in Adv. in electrochem. Science and Engineering (Eds. H. Gerischer, C. W. Tobias, Vol. 3, Weinheim 1994). As suitable electrolytes, there have been proposed complex compounds of general type $MX2AlR_3$, which are employed either as molten salts or in the form of their solutions in liquid aromatic hydrocarbons. MX may be either alkali metal (Na, K, Rb, Cs) or onium halides, preferably fluorides. R represent alkyl residues with preferably one, two or four carbon atoms.

The interest in electrolytic coatings of metal workpieces with aluminum has greatly increased due to the excellent corrosion protection by the aluminum layers and their ecological safety. Therefore, the galvanic coating with organoaluminum electrolytes which work at moderately elevated temperatures of between 60 and 150° C. and in closed systems is of great technical importance.

Since it has been sought, in recent years, to develop motor vehicles optimized in terms of consumption and weight, a consequent light-weight construction more and more requires the use of aluminum or magnesium or their mutual alloys. However, the light metal materials have a drawback in that both aluminum and magnesium have a high solution pressure in aqueous medium. Mainly upon contact with steels or conventionally galvanized steels, there is contact corrosion. For this reason, it is required to coat fixing members on magnesium applications in such a way that contact corrosion on the magnesium is avoided, on the one hand, and a long-term stability of the coating is obtained, on the other hand. The galvanic coating of the connecting screws with aluminum alone serves this function only partially since the corrosion products of the construction material magnesium are alkaline and attack the aluminum surfaces of the coating (B. Reinhold, S. G. Klose, J. Kopp, Mat.-wiss. u. Werkstofftech. 29, 1–8 (1998).

Methods for the galvanic deposition of aluminum-magnesium alloys on electrically conducting materials are known: J. H. Connor, W. E. Reed and G. B. Wood, J. Elektrochem. Sc. 104, 38–41 (1957), describe only briefly that they obtained a metal layer with 93% Al and 7% Mg having a good appearance upon electrolysis of $AlBr_3$, $Li[AlH_4]$, $MgBr_2$ (Mg/Al=0.8) in diethyl ether. J. Eckert and K. Gneupel obtained metal depositions with up to 13% Mg from a similar electrolyte of $AlCl_3$, $Li[AlH_4]$, $MgBr_2$ in a mixture of THF, diethyl ether and benzene (Mg/Al=0.6) (GDR Patent Specification 244573 A1). The conductivity of the electrolyte was on the order of $1.10^{-3}$ to $7.10^{-3}$ $S.cm^{-1}$. In the GDR Patent Specification 243723 A, the same authors describe an electrolyte solution consisting of ethylmagnesium bromide and triethylaluminum in THF/toluene 1:1 from which metal layers with a maximum of 10% Al were obtained.

Typical electrolytes, which have also proven technically useful for the deposition of aluminum, based on organoaluminum complex compounds of the type $M[R_3Al—X—AlR_3]$ (R=Et, iso-Bu; X=F, Cl; M=K, Cs, $N(CH_3)_4$) have been used for the electrochemical deposition of aluminum-magnesium alloys and magnesium by A. Mayer, J. Electrochem. Sci. 137 (1990), and in the U.S. Pat. No. 4,778,575 (priority of Oct. 18, 1988) after the addition of trialkylaluminum (R=Et, i-Bu) and dimethyl- or diethylmagnesium.

However, in a technical application of this method, the following problems arise, which render a continuously operating coating process impossible.

In contrast to aluminum anodes, magnesium anodes cannot be dissolved in the coating process with the proposed electrolytes. Continuous replenishing of the Mg content by dissolving the magnesium anode is not possible using organoaluminum complexes containing fluoride or generally halide as electrolytes.

According to the description in the U.S. Pat. No. 4,778,575, dialkyl magnesium in ethereal solution is employed for preparing the electrolyte. In a continuously working coating method, the dialkyl magnesium would have to be fed constantly in ethereal solution. However, diethyl ether is known to cleave some complexes, e.g., $Na[Et_3Al—F—AlEt_3]$ into $Na[Et3AlF]+Et_3Al.OEt_2$ (K. Ziegler, R. Köster, H. Lehmkuhl, K. Reinert, Liebigs Ann. Chem. 629, 33–49 (1960)). If the use of ether as the solvent for dialkyl magnesium was to be avoided, dialkyl magnesium would first have to be rendered ether-free, which requires considerable expenditure and costs, or it would have to be prepared in an ether-free form by the reaction of magnesium metal with di-alkylmercury, a very toxic compound.

For the reasons already described, it has been the object of the present invention to provide halide-free organoaluminum electrolytes which combine in themselves optimally the properties required for a technical application for the deposition of aluminum and aluminum-magnesium alloys, such as solubility of both aluminum and, in the case of alloy layers, magnesium anodes by electrolysis, as high as possible a conductivity, homogeneous solubility in aromatic solvents, such as toluene at between 20 and 105° C., cathodic deposition of dense layers of aluminum-magnesium alloys with selectable proportions of the two components of from Al:Mg=95:5 to 5:95.

The object has been achieved by the use of organoaluminum electrolytes which are characterized by containing either (in the case of electrolyte type I) alkali tetraalkylaluminate $M[AlR_4]$ or (in the case of electrolyte type II) alkali hexaalkylhydrido-dialuminate and additionally $M[AlR_4]$ as well as trialkylaluminum $AlR_3$ (R=$CH_3$, $C_2H_5$, $C_3H_7$ or n- or iso-$C_4H_9$; M=Li, Na, K, Rb, Cs), while electrolytes of composition $M[R_3Al—H—AlR_3]$ have proven particularly useful for the preparation of pure aluminum layers.

For reasons of optimizing solubility, specific conductivity and good accessibility, the ethyl compounds (R=$C_2H_5$=Et) are preferred. An electrolyte according to the invention of type I is dissolved in 2.5 to 6 mol per mole of complex compound of an aromatic hydrocarbon liquid at 20° C., preferably in toluene or a liquid xylene. The trialkylaluminum is preferably triethylaluminum ($AlEt_3$), and alkali tetraalkyl-aluminate is preferably a mixture of potassium and sodium tetraethylaluminates. The quantitative ratio of complex : $AlEt_3$ is from 1:0.5 to 1:3, preferably 1:2. The proportion of $Na[AlEt_4]$ is between 0 and 25 mole percent, based on the total amount of $K[AlEt_4]$ and $Na[AlEt_4]$, but preferably between 5 and 20 mole percent. The addition of low amounts of $Na[AlEt_4]$ is preferred because, when this component is lacking, the aluminum anodes are dissolved only with moderate to poor current efficiencies, e.g., only about 22% in $K[AlEt_4]/3AlEt_3/6$ toluene, which would lead to a loss of triethylaluminum for extended durations of the electrolysis. The electrolysis is performed at temperatures of between 80 and 105° C., preferably between 90 and 100° C.

An illustrative electrolyte I is 0.8 mol of $K[AlEt_4]/0.2$ mol of $Na[AlEt_4]/2.0$ mol of $AlEt_3/3.3$ mol of toluene. From this electrolyte solution, there is no crystallization even upon extended standing at room temperature, and the specific conductivity at 95° C. is 13.8 $mS.cm^{-1}$.

The addition of at least 0.3–0.5 mol of triethylaluminum is necessary to avoid the deposition of alkali metal during the electrolysis. The addition of larger amounts of $AlEt_3$ (2–3 mol $AlEt_3$ per mole of complex) has a very positive effect on the alloy deposition; the alloy layers obtained thereby have 5–50% by weight of Mg, are very uniform, have a silky gloss and are essentially pore-free at a layer thickness of as low as 4–6 $\mu$m. However, if the amount of triethylaluminum per mole of complex is increased from 2:1 to 3:1, it is required, in order to maintain a solution which is homogeneous even at room temperature, to add additional solvent to the electrolyte, i.e., to a total of 5.5–6 mol of toluene per mole of complex. However, the electrolyte loses conductivity thereby.

Electrolytes of type II preferably consist of mixtures of $Na[Et_3Al—H—AlEt_3]$, $Na[AlEt_4]$ and $AlEt_3$. Despite of unfavorable properties of individual components, e.g., a relatively high melting point of $Na[AlEt_4]$ of 125° C. and low solubility in toluene at 20° C., mixtures of the three components with a suitable mixing ratio (molar ratio $Na[Et_3Al—H—AlEt_3]$ to $Na[AlEt_4]$ of between 4:1 and 1:1, preferably 2:1) are homogeneously soluble in toluene at 20° C. and then have the properties required for a technical application for the deposition of aluminum-magnesium alloy layers, such as the solubility of both aluminum and magnesium anodes by electrolysis, as high as possible a conductivity, homogeneous solubility in aromatic solvents, such as toluene at between 20 and 105° C., cathodic deposition of dense layers of aluminum-magnesium alloys with selectable proportions of the two components of from Al:Mg=95:5 to 5:95. Due to the presence of $AlEt_3$, aluminum metal is deposited electrolytically from $Na[AlEt_4]$ rather than sodium metal (W. Grimme, dissertation TH Aachen (1960); DBP 1114330 (1959); DBP 1146258 (1961)). During electrolysis, $Na[AlEt_4]$ dissolves both aluminum and magnesium anodes (W. Grimme, dissertation TH Aachen 1960; K. Ziegler, H. Lehmkuhl, in Methoden der Organ. Chem. (Houben-Weyl), Vol. 13, 1, p. 281 (1970).

Electrolytes of composition $M[R_3Al—H—AlR_3]$ (M=Na, K, Rb, Cs; alkyl residue R=$CH_3$, $C_2H_5$, $C_3H_7$, $C_4H_9$), e.g., $Na[Et_3Al—H—AlEt_3]$, as solutions in toluene are very highly suitable for the electrolytic deposition and dissolution of aluminum at 90–105° C. However, we have found that magnesium anodes are not dissolved in the electrolysis of this compound in the absence of $Na[AlEt_4]$ according to the invention. After a current flow of 8.7 mF, the simultaneous use of an aluminum and a magnesium anode resulted in a weight loss of 8.7 meq of aluminum while the magnesium anode remained completely undissolved. This means that $Na[Et_3Al—H—AlEt_3]$ without $Na[AlEt_4]$ component represents an excellent electrolyte for the deposition of pure aluminum. However, for the preparation of aluminum-magnesium alloy coatings, the combination of both Na complexes with triethylaluminum and toluene has the effects a) that the solubility of $NaAlEt_4$ is sufficiently increased; and b) that both aluminum and magnesium anodes are dissolved in this electrolysis mixture.

The electrolyte II according to the invention is dissolved in 5–7 mol per mole of $Na[AlEt_4]$ of an aromatic hydrocarbon liquid at 20° C., preferably toluene or a liquid xylene. The quantitative ratio of $Na[Et_3Al—H—AlEt_3]$ to $Na[AlEt_4]$ is preferably 2:1 to ensure homogeneous solubility in 6 mol of toluene per mole of $Na[AlEt_4]$, and the molar ratio of $Na[AlEt_4]$ to $AlEt_3$ is preferably 1:2 to ensure perfect metal deposition by electrolysis. An illustrative electrolyte II is 1 mol of $Na[Et_3Al—H—AlEt_3]/0.5$ mol of $Na[AlEt_4]/1$ mol of $AlEt_3/3$ mol of toluene. Even upon extended standing at room temperature, there is no crystallization from this electrolyte solution which would interfere with the technical applicability of the electrolyte. Its specific conductivity at 95° C. is 8.12 $mS.cm^{-1}$.

The electrolytic deposition of aluminum-magnesium alloy layers from the electrolytes according to the invention is performed by using a soluble aluminum anode and a similarly soluble magnesium anode, or by the use of an anode made of an aluminum-magnesium alloy. In the case of two anodes, to ensure a continuous operation and for controlling to obtain a selectable and desired alloy composition, the two anodes are separately connected. The electrolyses are performed in toluene solution, conveniently at 90–100° C. The anodic (Al 95–100%; Mg 93–100%) and cathodic current efficiencies are practically quantitative. Since a finite and thus necessary concentration of magnesium in the electrolyte builds only in the course of the electrolysis, this condition must be brought about first before a freshly prepared electrolyte is employed. This can be done 1. by a short preliminary electrolysis during which the magnesium content in the cathodically deposited layer increases with increasing magnesium concentration in the electrolyte solution until the time when a suitable and desired selection of the anodic partial current densities causes that as much aluminum and magnesium is anodically dissolved as is cathodically deposited; or
2. by the addition of the complex compound $Mg[AlEt_4]_2$, a colorless liquid (K.

Ziegler, E. Holzkamp, Liebigs Ann. Chem. 605, 93–97 (1957)) which may also be used as a solution in toluene. After the addition of 0.01 mol of $Mg[AlEt_4]_2$ per 3.0 mol of $K[AlEt_4]$, for example, electrolyte I can be used directly for the coating according to the inventive method.

The electrolytic deposition from the electrolytes according to the invention yields aluminum-magnesium alloy layers which are clearly different from previously known layer systems in terms of their electrochemical properties. In the cathodic partial reaction, the electrochemical behavior of the alloy layers corresponds to the magnesium type, and in the anodic partial reaction, it corresponds to the aluminum type, associated with a pronounced passivity interval.

At room temperature in a 5% aqueous NaCl solution at a pH value of 9.0, the alloy layers have an open-circuit potential of about −1380 to −1500 mV versus S.C.E. at Mg incorporation rates of from 5 to 50% by weight. Due to the layer passivity (formation of intermetallic phases), the cathodic partial reaction is additionally inhibited upon contact with more electronegative metals, such as magnesium.

The potential of the cathodic partial reaction is thereby shifted towards even more negative potential values as compared to the open-circuit potential. As a consequence, the remaining potential difference between the cathodic partial reaction of the alloy layer (at pH 9: oxygen reduction) and the anodic partial reaction of the magnesium is highly reduced. Thus, the AlMg alloy layers enable substantial adaptation to the open-circuit potential of the magnesium alloy AZ91hp, which is about −1680 mV versus S.C.E., and the contact corrosion at the magnesium is highly reduced. Therefore, the alloy layers are suitable for the coating of steel fixing members in contact with magnesium. Potential applications include, in particular, applications in the automobile industry in the gear, engine and car body fields.

In addition, the alloy layers developed, which are deposited from non-aqueous electrolytes, are suitable as high quality surface coatings for highly heat-treated steel parts whose tensile strength is >1000 MPa and which cannot be coated with conventional galvanic methods due to the risk of hydrogen brittleness. Thus, there is a potential field of applications for the coating of heat-treatable and spring steels with alkali-resistant coatings compatible with aluminum and magnesium.

EXAMPLES

Of the subsequent Examples, Examples 1 to 9 relate to electrolyte I, Examples 10 to 14 relate to electrolyte II, and Examples 15 and 16 relate to pure aluminum deposition. In Example 17, an $Rb[Al(Et)_4]$ electrolyte was employed.

Example 1

189.5 g (1.14 mol) of $Na[AlEt_4]$ together with 216.8 g (2.35 mol) of toluene was heated to a bath temperature of 130° C. To the clear and colorless solution formed in the heat, 85 g (1.14 mol) of dried KCl is added in small portions. After the addition of the complete amount, stirring is continued for 6 h, the mixture is cooled down to room temperature, and the suspension is separated by filtering through a glass fiber thimble, followed by washing with 105 ml (91.0 g; 1.0 mol) of toluene. The total filtrate contains K:Na in a molar ratio of 0.79:0.21. Other K:Na ratios, for example, of 0.90:0.10, were adjusted by mixing the pure components $K[AlEt_4]$ and $Na[AlEt_4]$.

Example 2

An electrolyte of composition $M[AlEt_4]/3\,AlEt_3/6$ toluene (M=20 mole percent Na, 80 mole percent K) was electrolyzed at 91–95° C. with a rotating round Cu cathode positioned between the Al anode and the Mg anode. The current densities were controlled at 0.4 $A.dm^{-2}$ for the Al anode and 0.2 $A.dm^{-2}$ for the Mg anode, the amount of charge transported was 3.5 mF.

After this amount of charge had passed, 2.19 meq of Al and 1.17 meq of Mg had dissolved; the anodic current efficiency was 95.6% based on Al and 96.7% based on Mg. The cathode layer was uniform with a silvery gloss and contained 72.4% Al and 27.6% Mg, and the cathodic layer weighed 34.3 mg and was about 12 $\mu$m thick.

Upon long-term use of the electrolyte for numerous coating experiments at 90–95° C., the amount of toluene can gradually decrease by evaporation. When it falls below 5 mol of toluene per mole of $M[AlEt_4]$, the solution becomes inhomogeneous, and some $AlEt_3$ is segregated in the form of oily droplets. In this case, the amount of toluene must be replenished to 6 mol of toluene per mole of $M[AlEt_4]$.

Example 3

An electrolyte of composition 0.79 mol $K[AlEt_4]$/0.21 mol of $Na[AlEt_4]$/0.3 mol of $AlEt_3$/2.5 mol of toluene was electrolyzed at 90–95° C. between Al and Mg anodes and a copper cathode. The cathodic current density was 1 $A.dm^{-2}$ and the amount of charge transported was 8.65 mF. Thereafter, 2.77 meq of Al and 4.76 meq of Mg had dissolved, which corresponds to an anodic current efficiency of 87%. The cathode layer was uniform and glossy. It contained 71.0% by weight Al and 29.0% by weight Mg.

Example 4

The electrolyte of Example 3 was again electrolyzed at 90–95° C. after the cathode had been replaced by a new copper sheet. The cathodic current density was 0.9 $A.dm^{-2}$. After 6.53 mF had passed, the experiment was discontinued. The cathode layer was uniform and had a silvery gloss. It contained 54.9% by weight Al and 45.1% by weight Mg.

Example 5

The electrolyte of Examples 3 and 4 was electrolyzed four times in succession using only one magnesium anode. The condition of the cathode layer and the Al and Mg contents of the electrolyte are represented in Table 1.

TABLE 1

| Experiment | cathode layer | | | electrolyte, content in mat/g | |
|---|---|---|---|---|---|
| | | content in % by weight | | | |
| No. | appearance | Al | Mg | Al | Mg |
| 1 | uniform, light gray | 76.20 | 23.80 | | |
| 2 | uniform, getting rougher at the edges | 53.00 | 47.00 | 2.93 | 0.040 |
| 3 | gray, rough at the edges | 29.95 | 70.05 | 2.80 | 0.058 |
| 4 | gray, rough at the edges, dendritic | 4.60 | 95.40 | 2.85 | 0.070 |

Example 6

An electrolyte of composition $K[AlEt_4]/AlEt_3$/4 toluene with a specific conductivity of 17.3 $mS.cm^{-1}$ was electrolyzed at 90–95° C. between an anode consisting of an aluminum sheet and a magnesium sheet and a cathode consisting of $TiAl_6V_4$. The cathodic current density was 0.4 $A.dm^{-2}$, and after 5.59 mF had passed, 4,53 meq magnesium and 1.02 meq of aluminum (=99% anodic current efficiency) had dissolved. The cathode layer was very uniform and silvery and had good adhesion to $TiAl_6V_4$. It consisted of 75% by weight Al and 25% by weight Mg.

Example 7

An electrolyte of composition 0.8 mol of $K[AlEt_4]$/0.2 mol of $Na[AlEt_4]$/2.0 mol of $AlEt_3$/3.3 mol of toluene was electrolyzed at 97–102° C. between 2 anodes consisting of an aluminum-magnesium alloy with 25% by weight Mg and 75% by weight Al and a rotating cylindrical bolt M8 of heat-treatable steel (8.8) with a cathodic current density was 0.8 $A.dm^{-2}$ and an amount of charge transported of 2.89 mF. The cathodic and anodic current efficiencies were 99.5% and thus quantitative. The alloy layer of about 9 $\mu$m thickness was uniform and had a silvery gloss and good adhesion to the substrate material.

Example 8

To the electrolyte of Example 7, the bifunctional ether dimethoxyethane was added with stirring until a ratio of $AlEt_3$ to DME of 1:0.86 was reached. After heating to 95–98° C., electrolysis was performed between 2 anodes consisting of an aluminum-magnesium alloy with 25% by weight Mg and 75% by weight Al and a rotating cylindrical bolt of 8.8 steel with a cathodic current density of 0.8 $A.dm^{-2}$ and an amount of charge transported of 2.99 mF. The anodic current efficiency was 98.8%. The alloy layer of about 10 μm thickness was very uniform with a matt silvery appearance and had good adhesion to the substrate material.

Example 9

Example 7 was repeated ten times at 98–100° C., the cathode being replaced every time by an uncoated bolt. The respective thicknesses of the cathode layer were varied from 9 to 13 μm. Over the ten experiments, the anodic current efficiency was 99.5%.

Example 10

39.8 mol of $Na[Et_3Al—H—AlEt_3]$ and 39.8 mol of $Na[AlEt_4]$ and 78.6 mol of toluene are stirred at 100° C. Upon cooling to room temperature, fine crystals precipitate from the clear and viscous solution. Addition of another 39.8 mol of $Na[Et_3Al—H—AlEt_3]$ and 78.6 mol of toluene and heating to 100° C. yields a clear solution. Its specific conductivity at 95° C. is 21.8 $mS.cm^{-1}$. After the addition of 39.5 mol of toluene, a solution is obtained having a specific conductivity of 19.1 $mS.cm^{-1}$ at 95° C., and upon cooling to room temperature, some more crystals precipitate. Therefore, another 39.5 mol of toluene is added, and no crystallization occurs any more from the solution thus obtained upon cooling. The specific conductivity is 18.0 $mS.cm^{-1}$ at 95° C. A test electrolysis between Al and Mg anodes and a steel cathode only yielded a gray and rough, partly dendritic cathode layer. To the electrolyte, 79.8 mol of $AlEt_3$ was added, and its specific conductivity was 8.12 $mS.cm^{-1}$ for the thus obtained electrolyte of composition 1 $Na[Et_3Al—H—AlEt_3]$/0.5 $Na[AlEt_4]$/1 $AlEt_3$/3 toluene.

Example 11

The electrolyte obtained in the course of Example 10 was electrolyzed at 93–98° C. between Al and Mg anodes and a slowly rotating cylindrical cathode of heat-treatable steel (8.8). The anodic current density was 0.3 $A.dm^{-2}$ for each anode. After 1.6 mF had passed on each anode, the anodic current efficiency was quantitative, and the cathodically deposited layer was uniform and had a matt silvery appearance.

Example 12

The electrolyte of Example 11 was electrolyzed at 95–104° C. after replacing the cathode by a new one, which was also made of heat-treatable steel. The anodic current densities were adjusted to 0.45 $A.dm^{-2}$ for aluminum and 0.15 $A.dm^{-2}$ for magnesium. The anodic current efficiencies were 90%, and the cathode layer was uniform and had a silvery gloss. According to analysis, the layer contained 71.8% Al and 28.2% Mg. The layer thickness was 13 μm.

Example 13

After replacing the anodes of Al and Mg by two alloy anodes of composition 75% by weight Al and 25% by weight Mg and after substituting a new cylindrical cathode of heat-treatable steel 8.8, the electrolyte of Example 12 was electrolyzed at 93° C. During the electrolysis, the cathode rotated slowly between the two anodes. The cathodic current density was 0.8 $A.dm^{-2}$. After 3.5 mF had passed, the cathode layer was 12 μm thick and uniform and had a matt silvery appearance.

Example 14

After replacing the cathode by an uncoated one, Example 13 was repeated three times at 92–100° C. The respective layer thicknesses were varied between 10 and 15 μm. Over the 4 experiments, the anodic current efficiency was 98.9% for the alloy anodes.

Example 15

Al Deposition from $Na[Et_3Al—H—AlEt_3]$ 0.405 mol of $Na[(Et_3)AlH]$ was molten at 90° C., and 0.405 mol of $AlEt_3$ was added. The melt, which was originally somewhat milky, clarified upon the addition. After cooling to 20° C., a colorless liquid was obtained, which was diluted with 0.81 mol of toluene. The specific conductivity of this solution was 22.9 $mS.cm^{-1}$ at 100° C. A test electrolysis at 90–95° C. between an Al anode and a $TiAl_6V_4$ at an anodic current density of 0.7 $A.dm^{-2}$, after 8.7 mF had passed, yielded a silvery, silky cathode layer of aluminum with a quantitative current efficiency. The current efficiency at the aluminum anode was 96.6%.

Example 16

Al Deposition from $K[Et_3Al—H—AlEt_3]$

With the mother liquor obtained from the preparation and recrystallization of $K[Et_3Al—H—AlEt_3]$ (m.p. 138° C.) and having a composition of 1 mol of $K[Et_3Al—H—AlEt_3]$/8 toluene with a specific conductivity of 5.2 $mS.cm^{-1}$, a test electrolysis was performed at 94–96° C. between an Al anode and a Cu cathode at a current density of from 0.6 $A.dm^{-2}$ to 1.0 $A.dm^{-2}$. After 7.73 mF had passed, a uniform silver-gray cathode layer was obtained. The current efficiency at the cathode was 100.0%, and that at the anode was 99.6%.

Example 17 a) Preparation of $Rb[Al(Et)_4]$ 33.65 g (0.203 mol) of $Na[Al(Et)_4]$ together with 37.3 g (0.405 mol) of toluene was heated to a bath temperature of 90° C. To the suspension, 24.4 g (0.202 mol) of dry RbCl was added in 2 portions. After the addition, stirring is continued at 90° C. for 14 h. The slightly yellow to orange solution was cooled down to 70° C., and the suspension was separated by filtering through a glass fiber thimble, followed by washing with about 30 g of toluene. The filtrate is a clear solution with a slightly rusty color and contains Rb:Na in a molar ratio of 0.93:0.07. The analyses correspond to a composition of $M[Al(Et)_4]$ with 3.63 toluene (M=Rb+Na). The specific conductivity is 12.9 $mS.cm^{-1}$ at 95° C.

b) Example of an $Rb[Al(Et)_4]$ Electrolyte with $Al(Et)_3$ in Toluene

An electrolyte of composition $M[Al(Et)_4]$/2.17 $Al(Et)_3$/4 toluene (M=93 mole percent Rb, 7 mole percent Na) and a specific conductivity of 8.7 $mS.cm^{-1}$ at 95° C. was electrolyzed at 90–95° C. with a rotating steel bolt (8.8) as the cathode positioned between two AlMg25 alloy anodes. The current density was adjusted to 0.8 $A.dm^{-2}$ for the steel cathode. The amount of charge transported was between 3.5 and 6.0 mF in a total of 6 runs.

At the beginning, the cathode layers were uniform, bright matt, but gradually with a uniform silky silvery gloss, and were between 30 mg and 50 mg. The calculated layer thicknesses were from 12 to 20 μm. The anodic current efficiency was 100% over 6 experiments. The initial composition of the layer with a fresh electrolyte was 90.96% Al and 9.04% Mg. In the course of the further runs, the system conditioned to a layer composition of 75.02% Al and 24.98% Mg.

c) Example of an $Rb[Al(Et)_4]$ Electrolyte with $Al(n\text{-}C_3H7)_3$ in Toluene An electrolyte of composition $M[Al(Et)_4]/1.98\ Al[n\text{-}C_3H_7]_3/4.24$ toluene (M=93 mole percent Rb, 7 mole percent Na) and a specific conductivity of 4.6 $mS.cm^{-1}$ at 95° C. was electrolyzed at 90–95° C. with a rotating steel bolt (8.8) as the cathode positioned between two AlMg25 alloy anodes. The current density was adjusted to from 0.2 to 0.6 $A.dm^{-2}$ for the steel cathode. The amount of charge transported was between 3.5 and 7.0 mF. In all current density ranges, the cathode layers were optically uneven, dark and matt and were between 27 and 52 mg, and the calculated layer thicknesses were between 12 and 23 $\mu$m. The anodic current efficiency was 98.0% over 5 experiments.

What is claimed is:

1. An electrolyte for the electrolytic deposition of aluminum-magnesium alloys, characterized by containing an organoaluminum mixture essentially consisting of either alkali tetraalkylaluminate $M[AlR_4]$ or alkali hexaalkylhydridodialuminate $M[AlR_3—H—AlR_3]$ and alkali tetraalkylaluminate $M[AlR_4]$; and trialkylaluminum $AlR'_3$ and a magnesium component;

wherein

M=Li, Na, K, Rb or Cs; and

R, R'=$CH_3$, $C_2H_5$, $C_3H_7$ or n- or iso-$C_4H_9$, wherein R and R' are the same or different.

2. The electrolyte according to claim 1, wherein said organoaluminum mixture is an ethylorganoaluminum mixture which essentially consists of either $K[AlEt_4]$ (A) and $Na[AlEt_4]$ (B) with a molar ratio of B:A within a range of $0 \leqq B:A \leqq 1:3$; or $Na[Et_3Al—H—AlEt_3]$ (C) and $Na[AlEt_4]$ (D) with a molar ratio of D:C within a range of $1:4 \leqq D:C \leqq 1:1$; and trialkylaluminum (E).

3. The electrolyte according to claim 2, without an $Na[Et_3Al—F—AlEt_3]$ component, wherein the molar ratio of A:B is between 9:1 and 3:1, and the molar ratio of (A+B):E is between 1:0.5 and 1:3.

4. The electrolyte according to claim 3, wherein the molar ratio of A:B is 4:1.

5. The electrolyte according to claim 3, wherein said organoaluminum mixture is dissolved in 2–6 mol of toluene, based on the total amount employed of $Na[AlEt_4]$.

6. The electrolyte according to claim 2, without a $K[AlEt_4]$ component, wherein the molar ratio of D:C is 1:2 and that of D:E is from 1:2 to 1.1.

7. The electrolyte according to claim 2, and wherein said organoaluminum mixture is dissolved in 5–7 mol of toluene, based on the $Na[AlEt_4]$ employed.

8. The electrolyte according to claim 1, wherein triethylaluminum $AlEt_3$ is employed as said trialkylaluminum.

9. The electrolyte according to claim 1, wherein said organoaluminum mixture is dissolved in an aromatic hydrocarbon which is liquid at 20° C.

10. The electrolyte according to claim 9, wherein said organoaluminum mixture is dissolved in 2–6 mol of toluene, based on the total amount employed of $Na[AlEt_4]$ and $K[AlEt_4]$.

11. The electrolyte according to claim 9, wherein said organoaluminum mixture is dissolved in 5–7 mol of toluene, based on the $Na[AlEt_4]$ employed.

12. The electrolyte according to claim 1, wherein the organoaluminum components are dissolved in a mixture of a liquid aromatic hydrocarbon with an aliphatic mono-, di- or polybasic ether R"OR'" (R"=R'"=alkyl; or R"=alkyl, R'"=$CH_2$OR"), and the molar ratio of $AlR_3$:R"OR'" is between 0.5 and 1.0.

13. The electrolyte according to claim 12, wherein the aliphatic ether is dimethoxyethane $CH_3OCH_2CH_2OCH_3$, the aromatic hydrocarbon is toluene, and the molar ratio of triethylaluminum:dimethoxyethane is from 0.8 to 0.9.

14. A method for the electrolytic deposition of aluminum-magnesium alloys on electrically conductive materials, wherein an electrolyte according to claim 1 is employed, and aluminum and magnesium anodes or aluminum-magnesium alloy anodes are used as anodes, the composition of the anode alloy corresponding to that of the desired alloy coating.

15. The method according to claim 14, which is performed within a temperature range of from 80 to 105° C.

16. The method according to claim 14, wherein an alloy coating with an aluminum/magnesium ratio of between 95:5 and 5:95 is produced.

17. The method according to claim 14, wherein the magnesium concentration in the electrolyte necessary for the sought magnesium content of the alloy coating is adjusted by a preliminary electrolysis or by a single addition of $Mg[AlEt_4]_2$ at the beginning of the electrolysis.

18. The method according to claim 14 for reducing or avoiding contact corrosion on magnesium constructional parts, characterized in that Mg incorporation rates of from 5 to 50% by weight result in the formation of intermetallic phases within the alloy layer.

19. The method according to claim 18, wherein said magnesium constructional parts are constructional parts of the automobile industry in the gear, engine and car body fields.

20. The method according to claim 14 for avoiding $H_2$-induced environmental stress cracking, wherein high strength steel parts having a tensile strength of >1000 MPa are employed as electrically conductive materials.

21. The electrolyte according to claim 1, wherein said magnesium component is adjusted to the desired magnesium concentration in the electrolyte by preliminary electrolysis using Al—Mg anodes or by a single addition of $Mg[AlR_4]_2$.

22. A method for electrolytic deposition of aluminum, wherein $M[R_3Al—H—AlR_3]$ is employed as the electrolyte, wherein M=Na, K, Li, Rb or Cs, and the alkyl residue R=$C_2H_5$, $C_3H_7$, n- or iso-$C_4H_9$.

23. The method according to claim 22, wherein M=Na and R=$C_2H_5$.

24. The method according to claim 23, which is performed within a temperature range of from 20 to 105° C.

25. The method according to claim 24 within a temperature range of between 90 and 100° C.

26. The method according to claim 22, wherein the electrolyte is dissolved in a hydrocarbon which is liquid at 20° C.

27. The method according to claim 26, wherein said hydrocarbon is toluene.

* * * * *